United States Patent [19]

Sculatti

[11] Patent Number: 4,687,455

[45] Date of Patent: Aug. 18, 1987

[54] FLYING MODEL ROCKET AND METHOD OF RECOVERY

[76] Inventor: Ron Sculatti, 1567 Railroad Ave., St. Helena, Calif. 94574

[21] Appl. No.: 790,296

[22] Filed: Oct. 22, 1985

[51] Int. Cl.[4] ..... A63H 27/01; A63H 27/127; A63H 33/20

[52] U.S. Cl. ..... 446/52; 102/348; 446/56

[58] Field of Search ..... 446/34, 52, 56; 102/347, 348, 351

[56] References Cited

U.S. PATENT DOCUMENTS

| | | | |
|---|---|---|---|
| 2,683,330 | 7/1954 | Taylor | 446/56 |
| 3,415,010 | 12/1968 | Belz | 446/52 |
| 3,942,441 | 3/1976 | Senoski | 102/348 |
| 3,977,120 | 8/1976 | Held | 446/56 |

FOREIGN PATENT DOCUMENTS

| | | | |
|---|---|---|---|
| 1131559 | 6/1962 | Fed. Rep. of Germany | 102/348 |
| 617738 | 2/1949 | United Kingdom | 102/347 |

OTHER PUBLICATIONS

Estes Flying Model Rocket Catalog No. 841, Penrose, Colorado 81240.

*Primary Examiner*—Richard T. Stouffer
*Attorney, Agent, or Firm*—Townsend and Townsend

[57] ABSTRACT

A flying model rocket includes a body made up of several telescoping segments with a model rocket engine at one end. The telescoping segments are movable between a retracted condition, for ease of transport and storage, and an extended condition, for greater visibility. A recovery system includes a collapsible recovery surface, such as a parachute or paraglider, mounted to the outside of one of the telescoping segments, and a recovery surface containment structure, secured to an adjacent telescoping segment. According to the method of recovery, the recovery surface and the containment structure are positioned so that when their associated telescoping segments are telescopically retracted, the containment structure keeps the recovery surface in a stowed condition external of, and typically next to, the outer surface of the body. Upon actuation of the rocket engine ejection charge, such telescopic sections extend to uncover the recovery surface allowing it to be deployed so the model rocket descends slowly in a horizontal attitude.

14 Claims, 6 Drawing Figures

FLYING MODEL ROCKET AND METHOD OF RECOVERY

BACKGROUND OF THE INVENTION

This invention is related to flying model rockets, particularly of the type using a model rocket engine having an ejection charge for deployment of a recovery device, such as a parachute.

Model rockets are typically sold either assembled or in kit form. A typical model rocket uses a spiral wound paper tube for the body and balsa wood for the nose cone and fins. Although balsa is light, it is relatively fragile. The paper tubes are relatively inexpensive, but can limit the size of the rocket due to lack of strength.

People enjoy building model rockets, launching them, seeing them quickly ascend, reach their apex of flight and then return to earth, typically by deploying a parachute or streamer to slow the descent. A controlled, relatively slow descent is necessary to help prevent damage to the rocket and objects on the ground and to avoid injuring people and animals.

There are competing interests at work in the design of a model rocket. Many rockets are relatively small, under 2 feet in length, so they are light, for maximum height during flight, and so they can be transported and stored easily. Others are longer for better visibility during flight. Thus, although a 5 foot long rocket may be desirable from a visual standpoint, most rockets are much shorter so that they can be transported and stored more easily and to allow greater heights due to lower weight.

A common recovery system for model rockets uses a displaceable nose cone and a parachute. To deploy the parachute, this type of rocket uses a rocket engine having an ejection charge which ignites a short time after the boost charge is over and at about the time the model rocket is at its apex. The ejection charge produces a sudden surge of hot ejection gases inside the hollow rocket body to cause the parachute, housed in the body, to move forward dislodging the nose cone. However, there are a couple of problems with this recovery system. First, the rocket returns generally vertically and relatively rapidly because the rocket itself, being in a generally vertical orientation, provides little resistance to its descent. Enlarging the parachute to slow the descent may not be desirable due to the added weight. Another problem relates to protecting the paraohute. Wadding must be placed between the parachute and the source of the hot ejection gases to keep the parachute from being burned. If not done properly, the parachute can be partially or totally destroyed which can result in a faster than desired descent of the rocket. This can result in damage to the rocket, or in some cases, even injury to the user on the ground.

SUMMARY OF THE INVENTION

A flying model rocket made according to the invention includes a body made up of several telescoping segments. The visual interest of a long rocket is combined with the ease of transport and storage of a short rocket. Strong but light materials, such as plastic, rubber, reinforced paper, or glass fiber reinforced tubes, can be used.

The base segment of the body houses a conventional model rocket engine and typically has a number of fins extending from the base segment. The telescoping segments are movable between retracted, traveling and storage positions and extended, flight positions.

Another aspect of the invention relates to its novel recovery system and method of recovery. The recovery system includes a collapsible recovery surface, such as a parachute, streamers or a paraglider, mounted to the exterior of one of the telescoping segments. The recovery system also includes a recovery surface containment structure secured to another, typically adJacent, telescoping segment. According to the method of recovery, the recovery surface and the containment structure are positioned so that when the adjacent telescoping segments are at least partially telescopically retracted, the containment structure maintains the recovery surface in a stowed condition, typically next to the outer surface of the body. Upon actuation of the ejection charge of the rocket engine, the two adjacent telescopic sections are extended due to the sudden pressurization of the interior of the body. This releases the recovery surface to allow it to be deployed so the model rocket descends slowly.

When a parachute is used as the recovery surface, the parachute is preferably fastened to the center of gravity of the rocket when the rocket is fully extended after the ejection charge has fired; this permits the model rocket to return to earth slowly in a generally horizontal, and thus safer, attitude. When a paraglider is used as the recovery surface, it is secured to the body at at least two axially spaced apart points and is configured to produce an appropriate angle and path of descent.

If something malfunctions and the model rocket returns tip first, two features help prevent injury on impact. First, the telescoping nature of the rocket helps to reduce the impact force. Second, using a rubber nose at the tip of the rocket helps to prevent damage and injury.

A key feature of applicant's invention is that combining the telescoping body aspect with the external recovery system aspect allows the body structure itself to be used as the actuation mechanism for deploying the recovery surface. This combination also provides a simple and effective solution to several problems present with prior art model rockets: how to transport very long rockets, how to protect chute material from hot eJection gases and how to help slow the descent of a model rocket without having to increase the chute size and thus the weight.

Another advantage of the invention is that recovery systems which mount to the rocket body at more than one place along its length, such as a paraglider, can be used instead of parachutes or streamers. Paragliders or similar recovery systems, when used with the invention, provide very little air resistance during launch, for greatest height, but permit the model rocket to glide back to the ground; this combination of attributes are not found in the prior art recovery systems.

Other features and advantages will appear from the following description in which the preferred embodiments have been set forth in detail in conjunction with the accompanying drawings.

DETAILED DESCRIPTION OF THE PREFERRED EMBODIMENTS

Figure 1A:
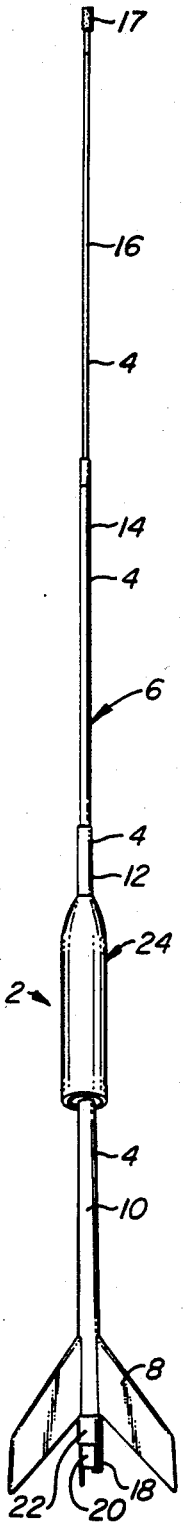
FIGS. 1A and 1B are side views of a first embodiment of a model rocket made according to the invention shown in the extended, pre-launch condition and the retracted, traveling or storage condition, respectively.
Figure 1B:
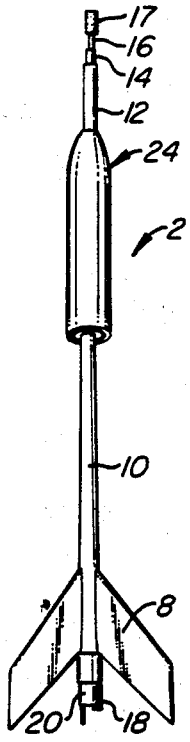
Figure 2:
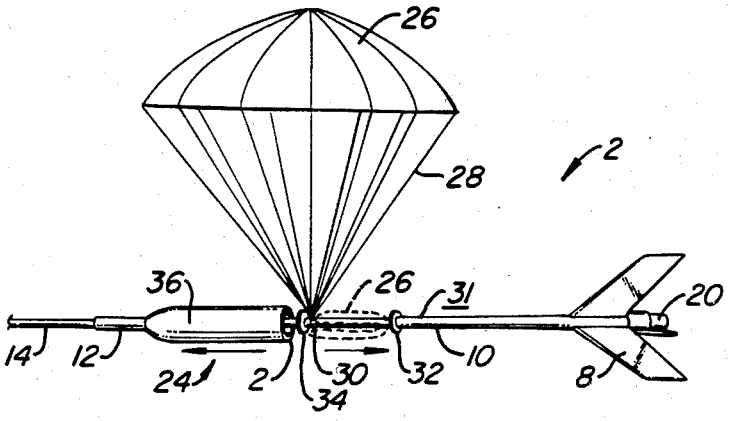
FIG. 2 is a partial side view of the model rocket of FIGS. 1A and 1B showing the rocket with a parachute type of recovery system deployed, the parachute attached so the rocket descends generally horizontally, the rocket being in its post ejection configuration.

Referring now to FIGS. 1A, 1B and 2, a model rocket 2 is shown to include four telescoping segments 4, which constitute a body 6. Fins 8 are secured to and extend from a base segment 10. The four telescoping segments 4 include base segment 10 plus a first intermediate segment 12, a second intermediate segment 14 and a tip segment 16. A rubber nose 17 is mounted to the outer end of segment 16 as a safety precaution. Telescoping segments 4, in the preferred embodiment, are made of lightweight hollow glass fiber reinforced tubes, similar to those used for collapsible fly rods, for both strength and light weight. Segments 10, 14 and 16 are tapered slightly over their entire lengths while segment 12 is tapered only over its end portions (for reasons discussed below) so by proper sizing, rocket 2 can be locked into the extended, launch condition of FIG. 1A. Base segment 10 includes a rocket motor clip 18 used to secure a conventional rocket motor 20 at a lower end 22 of base segment 10.

According to a broad aspect of applicant's invention, telescoping body 6 provides the user with an easily transportable, lightweight model rocket which, prior to launch, can be telescoped out into its extended, pre-launch condition. Thus, the pre-launch length of model rocket 2, shown in FIG. 1A, will be much longer, and thus more visible during flight, than the storage/travel length of FIG. 1B. Note that segments 10 and 12 remain telescopically retracted in the pre-launch condition of FIG. 1A. This will be discussed below.

Model rocket 2 also includes a recovery system 24 including a parachute 26, see FIG. 2, secured by its lines 28 to a point 30 along base segment 10. Parachute 26 is normally stowed adjacent the external surface 31 of base segment 10 between a pair of retainer discs 32, 34. Recovery system 24 also includes a windshield 36 mounted to first intermediate segment 12. Windshield 36 is a hollow or tubular member positioned to overlie and surround parachute 26 when parachute 26 is stowed between retainer discs 32, 34 and segment 12 is telescopically retracted into segment 10. This is shown in FIGS. 1A and 1B. When first intermediate segment 12 is telescopically extended relative to base segment 10, shown in FIG. 2, windshield 36 moves away from fins 8 thus exposing discs 32, 34 and releasing parachute 26. This occurs near the apex of the flight of rocket 2 when an ejection charge of engine 20 ignites which suddenly pressurizes the interior of body 6 causing segments 10, 12 to extend to release parachute 26. Segment 12, in this preferred embodiment, is not as long as the other segments since its length is determined mainly by the distance between discs 32, 34 needed to stow parachute 26.

Forward retainer disc 34 helps keep parachute 26 in place during this extension; without disc 34 parachute 26 would have a tendency to be carried forward with windshield 36 during the extension of segment 12. Aft retainer disc 32 helps keep parachute 26 in place during launch and through the flight until the ejection charge ignites. No packing or wadding is needed to protect parachute 26 from hot exhaust gases as is necessary with prior art model rockets since parachute 26 is mounted external of body 6. Since the telescoping arrangement of sections 10 and 12 is the same arrangement between each of the segments 4, no special mechanisms are needed to operate recovery system 24.

Figure 3:
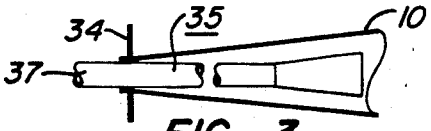
FIG. 3 is a cross-sectional view of a portion of the model rocket of FIG. 1B with the tapers of the segments greatly exaggerated.

FIG. 3 is an exaggerated cross-sectional view of segments 10, 12 in the telescopically retracted position of FIG. 1B illustrating the cylindrical outer surface 35 of a center portion 37 of segment 12. Surface 35 acts as a closely-fitting piston within segment 10 at disc 34. This prevents excess gas leakage during the ignition of the eject charge, which could occur if segment 12 were tapered along its entire length, for proper movement of sections 10, 12. Alternatively, an appropriate expanding seal could be used between segment 10 and the outer surface of segment 12 to prevent gas leakage.

Figure 4A:
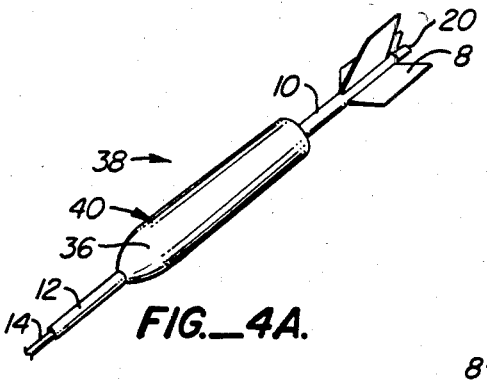
FIGS. 4A and 4B are partial perspective views of a second embodiment of the model rocket of FIG. 1A shown in a pre-launch configuration in FIG. 4A and a post-ejection configuration in FIG. 4B with a paraglider type of recovery surface deployed.
Figure 4B:
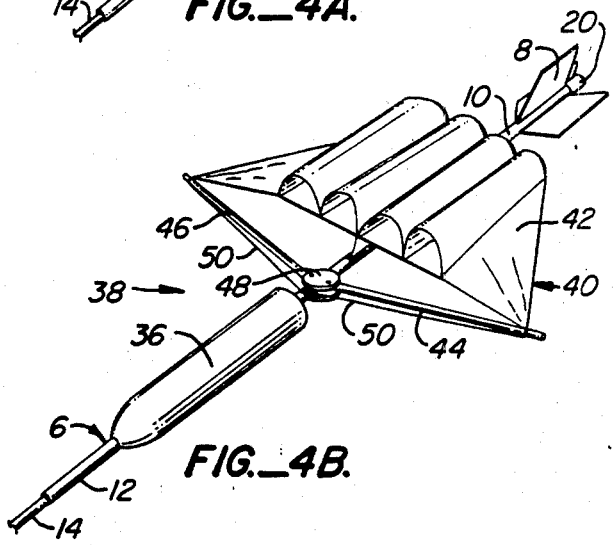

Referring now to FIGS. 4A and 4B, an alternative embodiment of the invention is disclosed. Like elements are designated with like numerals. Model rocket 38 includes a paraglider recovery system 40 mounted to base segment 10. Recovery system 10 includes a paraglider 42 secured along base segment 10 and a pair of pivot arms 44, 46 pivotally connected to base segment 10 by a pivot joint 48. Arms 44, 46 are biased to their outwardly extending positions of FIG. 4B by an elastic member 50. Stowage and deployment of recovery system 40 operate on the same principles as recovery system 24. That is, segments 10, 12 extend after ignition of the ejection charge of motor 20; this permits arms 44, 46 to extend outwardly under the influence of elastic member 50. This allows model rocket to glide back to the ground in a generally horizontal attitude. The angle of descent can be adjusted by adjusting the placement of paraglider 42 relative to the center of gravity of rocket 38 as well as modifying the size and configuration of the paraglider. The path of descent can be chosen to be either generally straight, or preferably a lazy spiral by the appropriate configuring of paraglider 42 with respect to body 6.

In use, the user first folds the recovery surface, such as parachute 26 or paraglider 40, to lie adjacent outer surface 31 of base segment 10. Segments 10, 12 are at least telescopically retracted so to cover the recovery surface. A model rocket engine 20 is mounted into lower end 22 of base segment 10. Tip segment 16 and second intermediate segment 14 are telescopically extended to the configration of FIG. 1A at the launch site. Depending on the length of windshield 36, first segment 12 may remain telescopically retracted within base segment 10 (as in the preferred embodiments) or be partially extended so long as parachute 26 or any other recovery is maintained in its stowed condition. If partially extended, an appropriate limit device may be used to keep first segment 12 from telescopically retracting into base segment 10 during launch. Model rocket engine 20 is then actuated, lifting model rocket 2 or 38 high into the air. At about the apex of the flight, the eject charge of engine 20 ignites suddenly filling the interior of body 6 with exhaust gases causing the relative telescopic extension of segments 10, 12. At this time, the recovery surface is deployed so that the model rocket can return to earth in a safe, controlled manner.

Modification and variation can be made to the disclosed embodiments without departing from the subject of the invention as defined in the following claims. For example, although rockets with four telescoping segments are shown, a greater or lesser number can be used as well. Although the recovery system of the invention is particularly well suited for use with rockets having several telescoping stages, it can be incorporated into a generally conventional rocket in which the rocket telescopes only enough to allow an externally carried recovery surface to be deployed in response to the ejection charge.

I claim;

1. A model rocket comprising:

a body including telescoping segments, the telescoping segments being displaceable from a collapsed condition to an extended condition;

a model rocket engine, including an ejection charge, secured to a base end of the body;

a fin mounted to the body to stabilize the rocket during flight; and a recovery system mounted to and external of the body, the recovery system including a collapsible recovery surface secured to a first of said telescoping segments and a recovery surface containment structure means, secured to a second of said telescoping segment, for maintaining the recovery surface in a stowed condition external of the body when the first and second telescoping segments are at least partially telescopically retracted and for releasing the recovery surface when the first and second segments are telesopically extended by the action of the ejection charge of the rocket engine so the recovery surface becomes deployed and the model rocket has controlled descent.

2. The model rocket of claim 1 wherein the model rocket engine is mounted to said first telescoping segment.

3. The model rocket of claim 1 wherein the collapsible recovery surface is a parachute.

4. The model rocket of claim 1 wherein the recovery system includes a pivotal deployment arm pivotally secured to the body and biased from a first position adjacent said body to a second position away from said body, and wherein said recovery surface is a paraglider connected to the deployment arm and to the first telescoping segment.

5. The model rocket of claim 4 wherein the recovery system includes two of said pivotal deployment arms.

6. The model rocket of claim 1 wherein the telescoping segments include tapered portions.

7. The model rocket of claim 1 wherein the second telescoping segment includes a cylindrical outer surface portion slidably engaging the first telescoping segment.

8. A model rocket comprising:

a body including at least three telescoping segments;

a model rocket engine at a base end of the body;

a stabilizing fin mounted to the body;

a recovery system mounted to and external of the body, the recovery system including:

a collapsible recovery surface secured to a first of the telescoping segments; and recovery surface containment means, secured to a second of the telescoping segments adjacent the first segment, for keeping said recovery surface in a stowed, non-deployed condition while the first and second segments are at a first, at least partially telescopically retracted relative orientation and for releasing said recovery surface when the first and second segments are in a second, substantially telescopically extended relative orientation so to permit deployment of the recovery surface; and said second telescoping segment including a cylindrical outer surface portion for sliding engagement with the first telescoping segment.

9. The model rocket of claim 8 wherein the recovery surface includes a parachute secured to a chosen position along the body so when the segments are telescopically extended, said chosen position is generally aliqned with the longitudinal center of gravity of the model rocket so the model rocket descends in a generally horizontal orientation.

10. The model rocket of claim 9 further comprising first and second parachute positioners mounted to an external surface of the first telescoping segment positioned to keep the parachute from shifting axially during the flight of the model rocket until after the first and second segments are in their second, substantially telescopically extended relative orientation.

11. The model rocket of claim 8 wherein the recovery surface containment means includes a generally cylindrical windshield mounted concentrically with the body.

12. A model rocket recovery method for use with a model rocket of the type having a body adapted to use a model rocket engine at a base end of the body, the engine of the type including an ejection charge, comprising the following steps:

positioning a collapsible recovery surface into a stowed orientation external of a first telescoping body segment, the recovery surface connected to the first body segment;

at least partially telescopically retracting said first and a second telescoping body segments so a recovery surface containment means, mounted to the second body segment, maintains the recovery surface in said stowed orientation;

actuating the model rocket engine so to propel the model rocket; and telescopically extending the first and second segments after and due to the ignition of the ejection charge to remove the recovery surface containment means from the recovery surface so the recovery surface is no longer maintained in said stowed orientation so the recovery surface is deployed to slow the descent of the model rocket.

13. The method of claim 12, wherein the recovery surface is a parachute.

14. The method of claim 12 wherein the recovery surface is a paraglider.

* * * * *